US008695949B2

(12) United States Patent
Stinson

(10) Patent No.: US 8,695,949 B2
(45) Date of Patent: Apr. 15, 2014

(54) FENCE ASSEMBLY

(76) Inventor: William H. Stinson, Troy, MI (US)

( * ) Notice: Subject to any disclaimer, the term of this patent is extended or adjusted under 35 U.S.C. 154(b) by 247 days.

(21) Appl. No.: 12/730,200

(22) Filed: Mar. 23, 2010

(65) Prior Publication Data

US 2011/0233499 A1 Sep. 29, 2011

(51) Int. Cl.
*E04H 17/14* (2006.01)

(52) U.S. Cl.
USPC ..... 256/67; 256/65.12; 256/64

(58) Field of Classification Search
USPC ..... 256/21, 22, 59, 67, 69, 65.01, 65.08, 256/65.12, 65.13, 70, DIG. 2
See application file for complete search history.

(56) References Cited

U.S. PATENT DOCUMENTS

| | | | | |
|---|---|---|---|---|
| 2,218,953 | A * | 10/1940 | Gustafson | 256/22 |
| 3,414,236 | A * | 12/1968 | Siegal | 256/22 |
| 3,506,243 | A * | 4/1970 | Seiler | 256/59 |
| 4,014,520 | A * | 3/1977 | Walters | 256/22 |
| 5,660,378 | A * | 8/1997 | Schall | 256/65.12 |
| 6,375,166 | B1 * | 4/2002 | Schall et al. | 256/65.08 |
| 6,752,385 | B2 * | 6/2004 | Zen et al. | 256/65.01 |
| 6,796,549 | B1 * | 9/2004 | Lester | 256/59 |
| 7,152,849 | B2 * | 12/2006 | Graber | 256/22 |
| 7,384,025 | B2 * | 6/2008 | Lo | 256/65.08 |
| 7,635,115 | B2 * | 12/2009 | Lehmann | 256/65.12 |
| 7,677,535 | B1 * | 3/2010 | Lo | 256/65.08 |
| 2005/0127344 | A1 * | 6/2005 | Graber | 256/22 |
| 2009/0065755 | A1 * | 3/2009 | Sherstad | 256/22 |
| 2009/0166599 | A1 * | 7/2009 | Lo | 256/65.01 |
| 2010/0155683 | A1 * | 6/2010 | Payne et al. | 256/67 |
| 2010/0200827 | A1 * | 8/2010 | Duffy et al. | 256/67 |
| 2010/0252793 | A1 * | 10/2010 | Ash | 256/65.02 |
| 2010/0264388 | A1 * | 10/2010 | Duffy et al. | 256/22 |
| 2011/0042637 | A1 * | 2/2011 | Howard et al. | 256/22 |
| 2013/0181179 | A1 * | 7/2013 | Langenwalter et al. | 256/67 |

* cited by examiner

*Primary Examiner* — Joshua Kennedy
(74) *Attorney, Agent, or Firm* — Gifford, Krass, Sprinkle, Anderson & Citkowski, P.C.

(57) ABSTRACT

An improved fence assembly is comprised of a plurality of pickets, an inner rail and an outer rail. The pickets are vertically oriented and attached to the inner rail. The inner rail has an upper locking seat, a lower locking seat and a recess between the seats. The fasteners attaching the inner rail to the pickets have their heads entirely enclosed within the recess. The outer rail snap fits over the inner rail. The outer rail is securely attached to the inner rail, but it may slide along the inner rail. The outer rail has an upper locking tang, a lower locking tang and a tensioning wall. These components slidingly interlock with the inner rail locking seats to provide a fence assembly wherein the outer rail is slidingly attached to the inner rail and the fasteners securing the inner rail to the pickets are hidden.

3 Claims, 3 Drawing Sheets

FENCE ASSEMBLY

BACKGROUND OF THE INVENTION

Fences comprised of vertically oriented pickets attached by one or more rails are commonly used. Typically, each rail is attached to multiple pickets with screws. This provides a secure attachment which allows the rail to pivot about the screw axis. Therefore, such a fence does have a limited ability to be used on an incline because the angle between the pickets and the rail may be adjusted. However, the adjustability of the angle is limited by the fact that the screw attaches the rail to the pickets. Further, the screw heads are exposed. This is not aesthetically pleasing.

What is needed is a device which allows the screws to be covered. Such a device does exist. For example, see U.S. Pat. No. 6,752,385 issued to Zen et al. Although the screw heads are covered in that device, the adjustability of the angle between the pickets and the rail remains limited because the inner rail is directly attached to the pickets. What is also needed is a fence assembly wherein the rail may be quickly and easily installed onto and removed from the pickets. Ideally, the rail and the pickets would not be pivotally connected to each other. This would allow greater adjustability to the angle between the rail and the pickets. Such greater angle adjustability permits the fence assembly to be used on a larger variety of terrains and inclines. Preferably, the pickets would be attached to each other with an inner rail and an outer rail would snap fit over the inner rail. The outer rail should be able to slide relative to the inner rail.

SUMMARY OF THE PRESENT INVENTION

The fence assembly described herein is comprised of a plurality of pickets, an inner rail and an outer rail. The pickets are traditional fence pickets.

The inner rail is a strip comprising an upper locking seat, a lower locking seat and a fastener recess. The fastener recess is positioned between the seats. The upper locking seat has an upper locking seat horizontal member and an upper locking seat vertical member. The lower locking seat has a vertical base and a lower locking seat horizontal member extending from the vertical base. The horizontal members form two walls which define walls of the recess. The lower wall is longer than the upper wall. The depth of the recess is sufficient to cover the head of a fastener positioned within the recess when the fastener is used to secure the inner rail to a picket. The inner rail is fastened to the plurality of pickets with one or more fasteners. The head of each fastener is enclosed within the recess.

The outer rail has an upper locking tang, a lower locking tang and a tensioning wall. The upper locking tang has an upper locking tang horizontal member and an upper locking tang vertical member. The upper locking tang vertical member extends vertically from the upper locking tang horizontal member. The upper locking tang vertical member is sized and shaped to fit adjacent to the upper locking seat vertical member such that horizontal movement of the outer rail is limited by contact between the upper locking tang vertical member and the upper locking seat vertical member. The upper locking tang horizontal member is sized and shaped to fit above the upper locking seat vertical member such that vertical movement of the outer rail is limited by contact between the upper locking tang horizontal member and the upper locking seat vertical member. The lower locking tang is sized and shaped to fit adjacent to the vertical base and the horizontal member of the lower locking seat such that horizontal and vertical movement between the lower locking tang of the outer rail and the lower locking seat is limited. The tensioning wall is adapted to maintain contact with a picket extending into the outer rail.

The outer rail snap fits over the inner rail to secure the outer rail to the pickets. Horizontal and vertical movement between the outer rail and the pickets is limited. The angle between the outer rail and the pickets is adjustable. The heads of the fasteners within the recess, which attach the inner rail to the pickets, are covered by the outer rail.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

The preferred fence assembly is comprised of a plurality of pickets 20, an inner rail 22 and an outer rail 42. The pickets 20, inner rail 22 and outer rail 42 are configured to form a fence assembly.

The pickets 20 are conventional fence pickets. In a fence assembly they are vertically oriented. Typically, the pickets 20 have a rectangular or square cross-section. They may be extruded from aluminum. The inner rail 22 and the outer rail 42 may also be extruded from aluminum. Aluminum is extrudable, light weight, has a relatively low cost and is resistant to oxidation.

Figure 1:
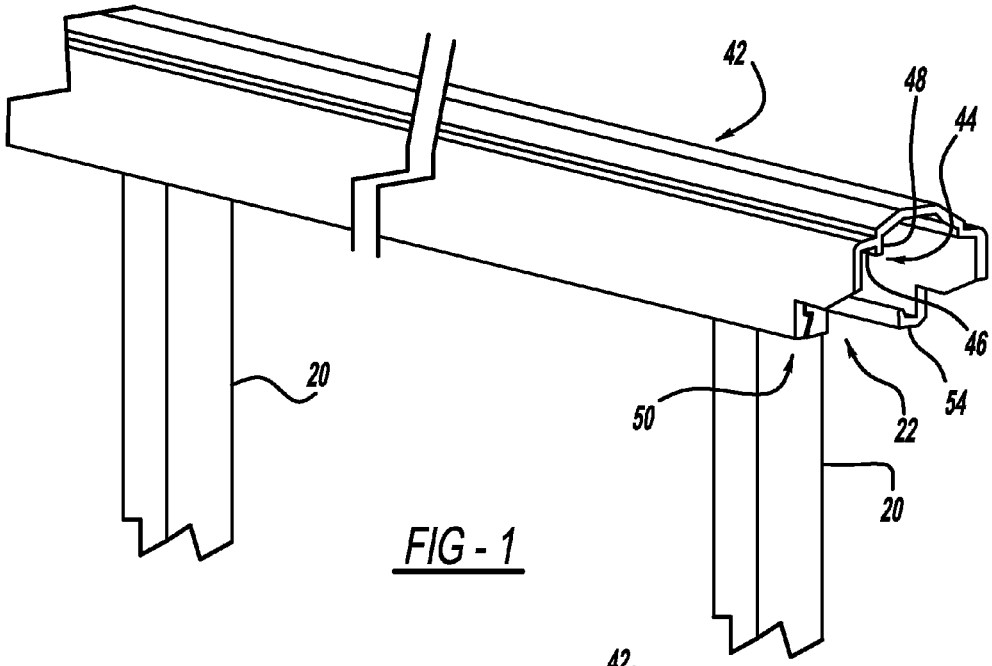
FIG. 1 is a perspective view of a fence assembly.
Figure 2:
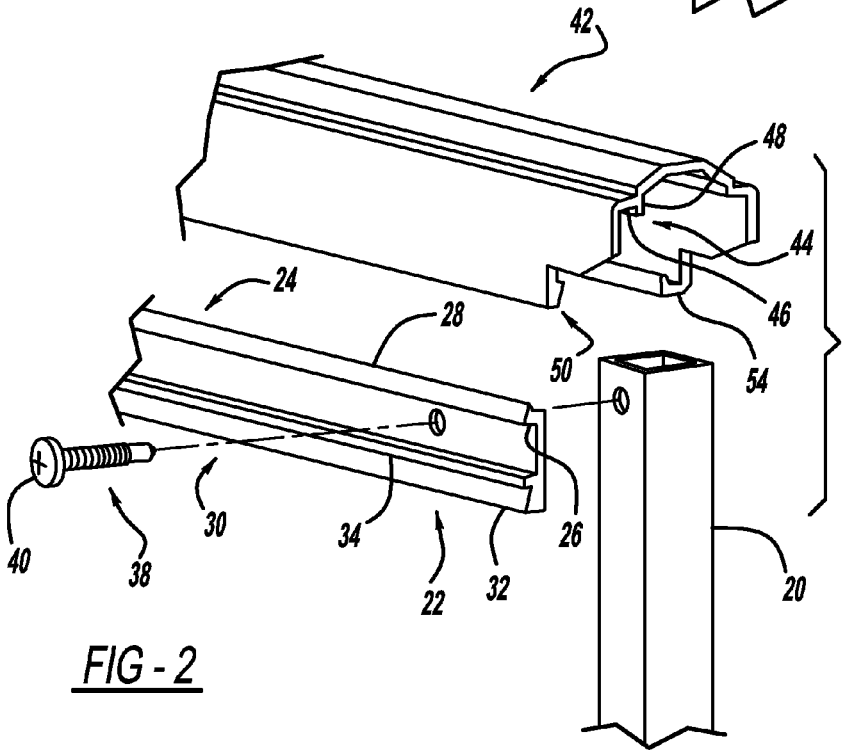
FIG. 2 is an exploded perspective view of a part of the fence assembly of FIG. 1.
Figure 3:
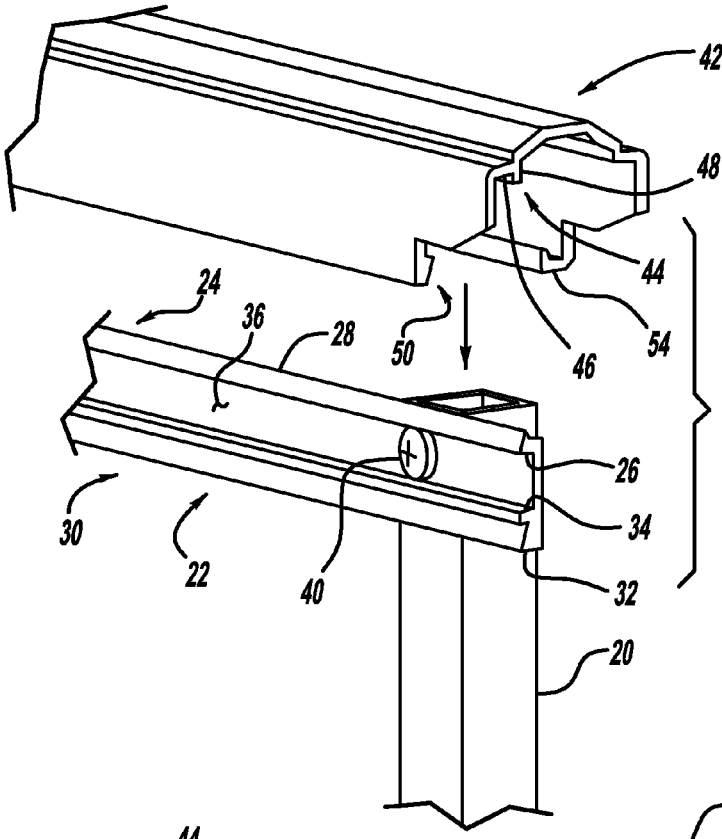
FIG. 3 is a partial exploded perspective view of a part of the fence assembly of FIG. 1, wherein the inner rail of the fence assembly is secured to a picket with a screw.
Figure 4:
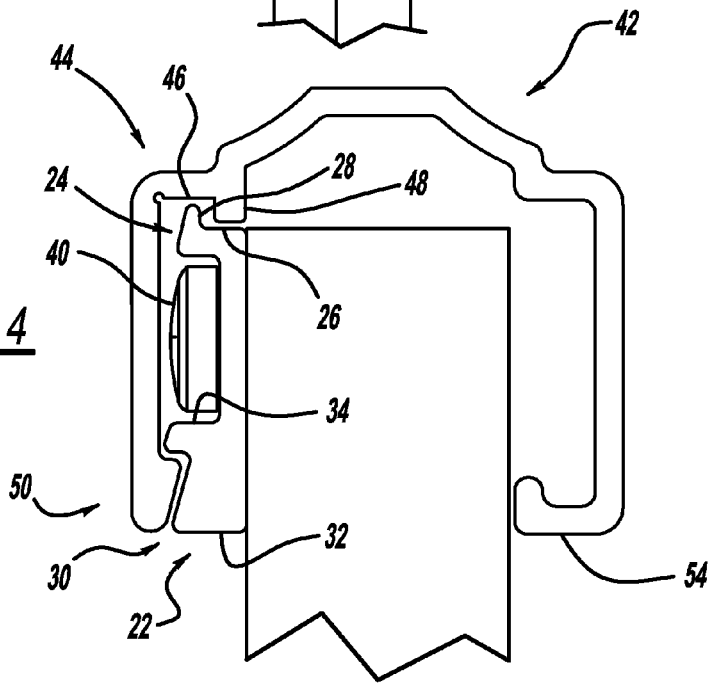
FIG. 4 is a sectional side view of the fence assembly of FIG. 1 showing the relationship between the outer rail, the inner rail and a picket.
Figure 5:
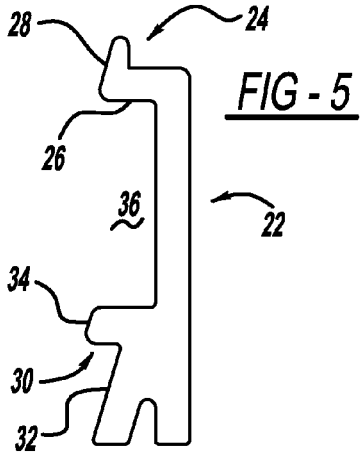
FIG. 5 is a sectional side view of an alternate embodiment of the inner rail of FIG. 3.

The pickets 20 in a fence assembly are secured in a vertical configuration by an inner rail 22 fastened to the pickets 20. The inner rail 22 has an upper locking seat 24, a lower locking seat 30 and a fastener recess 36 positioned between the locking seats 24, 30. The upper locking seat 24 has an upper locking seat horizontal member 26 and an upper locking seat vertical member 28, as shown in FIG. 4. The upper locking seat horizontal member 26 and the upper locking seat vertical member 28 form an upper wall projecting from the inner rail 22. The upper locking seat vertical member 28 is a substantially vertical projection from this wall positioned on the distal end of the upper locking seat horizontal member 26.

Preferably, the distal end of the upper locking seat vertical member 28 is at a clockwise acute angle with respect to the upper locking seat horizontal member 26. This upper wall has a shorter length than the lower wall of the inner rail 22 described below. The lower locking seat 30 has a vertical base 32 and a lower locking seat horizontal member 34. The lower locking seat horizontal member 34 extends from the vertical base of 32, as shown in FIG. 4. The vertical base 32 of the lower locking seat 30 is provided with an indentation for receiving the lower locking tang 50 of an outer rail 42, as shown in FIG. 4. The top of the indentation is defined by the bottom surface of the lower locking seat horizontal member 34. The side of the indentation is defined by a vertical portion of the vertical base 32 of the lower locking seat 30. This vertical portion is preferably acutely angled with respect to the vertical direction and the bottom portion of the vertical base 32 of the lower locking seat 30, as shown in FIG. 4. As a result, the lower locking tang 50 will snap into and be secured by the indentation. The horizontal member 34 of the lower locking seat 30 forms a lower wall projecting from the inner rail 22. Thus, the horizontal member 26 of the upper locking seat 24 and the horizontal member 34 of the lower locking seat 30 form two walls on the inner rail 22. The walls of the inner rail 22 define a recess 36. The fasteners 38 are positioned within the recess 36 in order to secure the inner rail 22 to a picket 20. The recess 36 has sufficient depth such that the head 40 of a fastener 38, such as a screw, positioned within the recess 36 to secure the inner rail 22 to a picket 20, is enclosed within the recess 36. This facilitates the covering of the fastener head 40 by the outer rail 42 without the fastener head 40 coming into contact with the outer rail 42. The lower seat horizontal member 34 forms a longer wall than the wall formed by the upper seat horizontal member 26, as shown in FIG. 4. This will facilitate installation (by snapping) and removal of the outer rail 42 from the inner rail 22. The inner rail 22 is fastened to the plurality of pickets 20 with one or more fasteners 38. The heads 40 of each fastener 38 are enclosed within the recess 36.

The outer rail 42 has an upper locking tang 44, a lower locking tang 50 and a tensioning wall 54, as shown in FIG. 4. The upper locking tang 44 has an upper locking tang horizontal member 46 and an upper locking tang vertical member 48 extending from the upper locking tang horizontal member 46. This is shown in FIG. 4. The upper left portion of that figure shows the upper locking tang 44. The upper locking tang 44 has a horizontal member 46. The upper locking tang vertical member 48 extends vertically from the upper locking tang horizontal member 46. Reference directions such as vertical and horizontal refer to directions relative to a traditional fence. When an outer rail 42 is snapped over an inner rail 22 the upper locking tang vertical member 48 is trapped into a locked positioned by the upper locking seat vertical member 28, as shown in FIG. 4. The pickets are vertically oriented. The rails are horizontally oriented. The reference directions are not absolute. For example, when a fence is installed upon a hill the pickets may be vertically oriented and the rails horizontally oriented with respect to the hill, but not so oriented with respect to a flat non-inclined part of the ground. Vertically oriented and horizontally oriented mean substantially vertically oriented and substantially horizontally oriented, respectively. The upper locking tang horizontal member 46, the upper locking tang vertical member 48 and the upper portion of the tensioning wall 54 form a U-shaped configuration. The upper locking tang vertical member 48 is sized and shaped to fit adjacent to the upper locking seat vertical member 28, as shown in FIG. 4, such that horizontal movement of the outer rail 42 is limited by contact between the upper locking tang vertical member 48 and the upper locking seat vertical member 28. The upper locking tang horizontal member 46 is sized and shaped to fit above the upper locking seat vertical member 28, as shown in FIG. 4, such that vertical movement of the outer rail 42 is limited by contact between the upper locking tang horizontal member 46 and the upper locking seat vertical member 28. The lower locking tang 50 is sized and shaped to fit adjacent to the vertical base 32 and the horizontal member 34 of the lower locking seat 30, as shown in FIG. 4, such that horizontal and vertical movement between the lower locking tang 50 of the outer rail 42 and the lower locking seat 30 is limited. Preferably, the lower locking tang 50 bottom surface is beveled with a convex contour, as shown in FIG. 4. This will cause the lower locking tang 50 to snap over the horizontal member 34 of the lower locking seat 30 when downward pressure is applied to the outer rail 42 while the lower surface of the lower locking tang 50 is in contact with the upper surface of the lower locking seat horizontal member 34. This occurs during installation. Preferably, the lower locking tang 50 is notched and angled to fit within the lower locking seat 30 of the inner rail 22, as shown in FIG. 4. The angle of the proximal end of the lower surface of the lower locking tang 50 preferably matches the previously described angle formed on the vertical base 32 of the inner rail 22. The tensioning wall 54 is adapted to maintain contact with a picket 20 extending into the outer rail 42. As shown in FIG. 4, the tensioning wall 54 is an L-shaped wall extending vertically from the outer rail 42. The tensioning wall 54 is adapted to impart a springlike force upon a picket 20. The interaction between the outer rail 42 and the inner rail 22 when the outer rail 42 is snapped over the inner rail 22 is such that the outer rail 42 is securely attached to the inner rail 22. Horizontal and vertical movement between the outer rail 42 and the pickets 20 is limited. However, the angle between the outer rail 42 and the pickets 20 is adjustable, as shown and FIG. 6D.

Figure 6A:
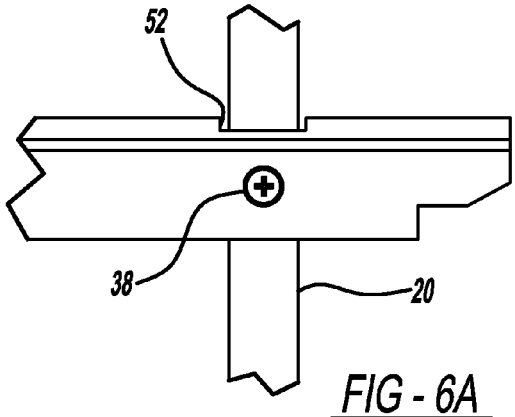
FIG - 6A Prior Art
FIG. 6A is a front view of a prior art fence construction showing an outer rail perpendicularly mounted to a picket.
Figure 6B:
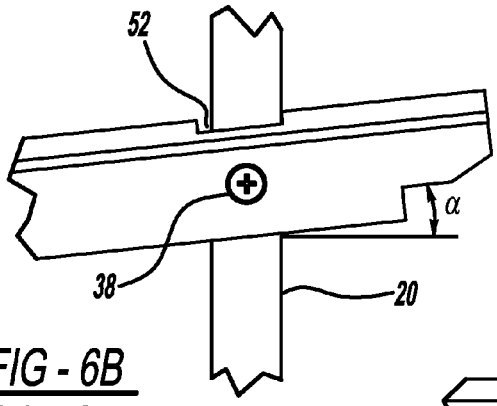
FIG - 6B Prior Art
FIG. 6B is a front view of a prior art fence construction showing an outer rail angled with respect to a picket, wherein the angle is limited by the pivot point resulting from the attaching screw and the opening within the outer rail.
Figure 6C:
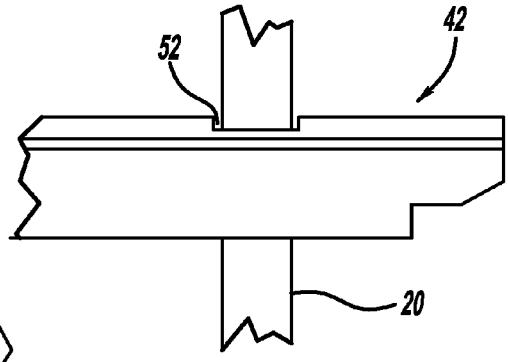
FIG. 6C is a front view of a section of the fence assembly described herein, wherein the outer rail is installed upon the inner rail and a picket extends through the outer rail.
Figure 6D:
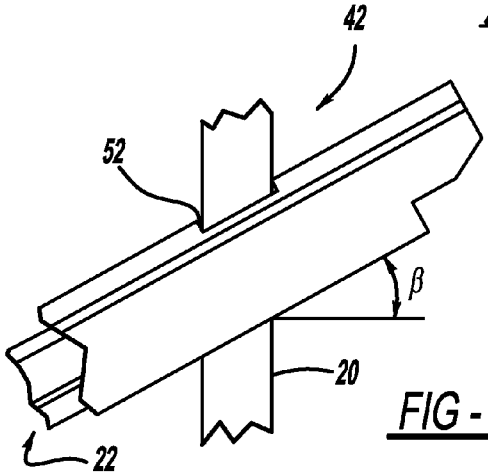
FIG. 6D is a front view of this section of the fence assembly shown in FIG. 6 wherein the outer rail is maximally angled with respect to the picket.

The upper surface of an outer rail 42 may be a closed surface if the outer rail 42 is the upper rail of a fence. In other words, the pickets 20 may or may not extend through the upper outer rail 42. However, outer rails 42 below the top outer rail 42 must have openings 52. The openings 52 are necessary in order for the pickets 20 to extend through the outer rails 42. The outer rails 42 may or may not have an enclosed lower surface. An enclosed lower surface on an outer rail 42 results in that rail having four walls forming a rectangular structure. In this case the bottom wall of the outer rail 42 must have an opening for a picket 20 to extend into that outer rail 42. The preferred embodiment described and illustrated in FIG. 4 allows the outer rail 42 to slide along the inner rail 22. This is illustrated in FIGS. 6C and 6D. There, a picket opening 52 is illustrated in the upper surface of an outer rail 42. The opening 52 is larger than the picket 20. This allows the outer rail 42 to be angled with respect to the picket 20, as shown in FIG. 6D. This angling has a very practical application. When a fence is installed on an incline such as a hill the outer rail members 42 and the pickets 20 are not perpendicular to each other. A perpendicular orientation is shown in FIG. 6C. It is important for a fence installer to be able to angle the outer rails 42 with respect to the pickets 20 in order to properly install a fence on an incline. As shown in FIG. 6D, the angle can be maximized by utilizing the entire width of the opening 52 within the outer rail 42. The entire width of the opening 52 of the outer rails 42 of the fence assembly described herein may be utilized, as shown in FIG. 6D. The entire width may be utilized because the outer rail 42 can slide relative to the inner rail 22. This should be compared to a traditional picket/outer rail construction, as shown in FIG. 6A and FIG. 6B. In this prior art construction the outer rail is directly secured to the picket with a screw. Although the screw allows the outer rail to pivot, the pivot angle is limited because the outer rail is directly secured to the picket, as shown in FIG. 6B.

In the fence assembly described herein the outer rail 42 snap fits over the inner rail 22. This secures the outer rail 42 to the pickets 20. Horizontal and vertical movement between the outer rail 42 and the pickets 20 is limited. However, the angle between the outer rail 42 and the pickets 20 is adjustable because the outer rail 42 may slide along the inner rail 22. The inner rail 22 is secured to the pickets 20 by fasteners 38, such as screws. The heads 40 of the fasteners 38 are confined to the recess 36 of the inner rail and they are covered by the outer rail 42.

A similar prior art fence assembly is disclosed in U.S. Pat. No. 7,384,025. The fence assembly described herein has a number of advantages compared to the prior art. The fit between the outer rail 42 and the inner rail 22 and the configuration of those components allows a greater extrusion tolerance with respect to the manufacturing of the outer rails 42 and the inner rails 22. Greater absolute dimension deviations can be tolerated for the fence assembly described herein before there is a failure of the connection between the outer rail 42 and the inner rail 22. The tensioning wall 54 tends to keep the pickets 20 properly positioned within the outer rail 42, as opposed to be being pushed to one side of the outer rail 42. The downward pressure of the upper locking tang 44 upon the upper locking seat 24 results in a stronger more stable rail. The increased height of the inner rail 22 permitted by the current design enhances the likelihood that the pickets 20 will remain properly aligned with the outer rails 42. The recess 36 of the inner rail 22 is of sufficient size to receive the heads of Philips pan head screws as well as a variety of other fastener heads. There is an increased ability to angle the outer rail 42 with respect to the pickets 20 because of the ability of the outer rail 42 to slide along the inner rail 22, as previously described. The fence assembly described has greater strength because it does not rely upon a relatively short upper rib/stopper to properly secure and position the outer rail 42 with respect to the pickets 20.

Although the invention has been shown and described with reference to certain preferred embodiments and methods, those skilled in the art undoubtedly will find alternative embodiments and methods obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A fence assembly, comprising:

a plurality of pickets adapted to being supported in upwardly extending and spaced apart fashion upon a ground location, each of said pickets exhibiting a tubular cross section;

an elongated inner rail exhibiting a base surface abutting a side of each picket forming a portion of said tubular cross section, said inner rail having upper and lower projecting locking seats between which is defined a surface exposed and length extending recess, a plurality of fasteners inserting through apertures defined along said inner rail and in each of said pickets in order to pivotally associate said pickets to said inner rail and so that a head of each fastener is enclosed within said recess;

an outer rail exhibiting a generally three sided configuration in cross section with an underside accessible interior, said outer rail configured for snap engagement over said inner rail and around said pivotally associated pickets to permit said outer rail to slidably displace along said inner rail and pickets during angular adjustment between said pickets and inner rail to account for variations in terrain and incline of the ground location along which said assembly extends;

an upper horizontal extending portion of said outer rail extending to a first downwardly extending side further including an innermost located and downwardly extending upper tang seating inwardly relative to an upper and outermost extending terminating portion of said inner rail upper locking seat, said first downwardly extending side of said outer rail further having a lower tang with an inclined inner surface resiliently engaging over a mating surface associated with said inner rail lower locking seat, and so that said outer rail obscures said fastener heads; and a second downwardly extending side of said outer rail having a bottom end located and inwardly angled tensioning wall including both a horizontal portion and a vertical/upward extending end-most portion, said tensioning wall contacting an opposite side of said pickets and, in combination with said upper and lower tangs on said first downwardly extending side of said outer rail, facilitating slidable adjustability relative to said inner rail and pickets.

2. The fence assembly as described in claim 1, further comprising an interior clearance established between a raised middle portion associated with an upper interconnecting side of said outer rail and top edges of each of said pickets.

3. The fence assembly as described in claim 1, further comprising each of said inner rail, outer rail and pickets being constructed of an extruded aluminum.

* * * * *